US005752413A

United States Patent [19]

Kuhn et al.

[11] Patent Number: 5,752,413

[45] Date of Patent: May 19, 1998

[54] RECIPROCATING PISTON MACHINE WITH A WOBBLE PLATE GEAR

[75] Inventors: Peter Kuhn, Weinheim, Germany; Frank Obrist, Dornbirn, Austria

[73] Assignee: TES Wankel Technische Forschungs-und Entwicklungsstelle Lindau GmbH, Lindau, Germany

[21] Appl. No.: 666,642

[22] Filed: Jun. 18, 1996

[30] Foreign Application Priority Data

Jul. 5, 1995 [CH] Switzerland ..... 01 957/95

[51] Int. Cl.[6] ..... F16H 23/06; F04B 1/12

[52] U.S. Cl. ..... 74/60; 92/71; 92/165 PR; 417/269

[58] Field of Search ..... 74/60; 92/71, 165 PR; 417/269

[56] References Cited

U.S. PATENT DOCUMENTS

| | | | |
|---|---|---|---|
| 4,489,682 | 12/1984 | Kenny | 92/12.2 X |
| 4,875,834 | 10/1989 | Higuchi et al. | 74/60 |
| 5,382,139 | 1/1995 | Kawaguchi et al. | 417/269 |
| 5,615,599 | 4/1997 | Terauchi | 92/71 X |

*Primary Examiner*—Allan D. Herrmann
*Attorney, Agent, or Firm*—Ladas & Parry

[57] ABSTRACT

The reciprocating piston machine has a wobble plate gear, in which the pistons (2) are connected in articulated manner to the circumference of the wobble plate (3) by in each case one ball end (21), which engages directly or by means of an interposed slip ring (29) with a spherical inner face (30) in a guide (28) directed transversely to the piston axis. As this leads to the avoidance of connecting rods with in each case two ball ends, the machine can be given a more compact construction.

20 Claims, 4 Drawing Sheets

RECIPROCATING PISTON MACHINE WITH A WOBBLE PLATE GEAR

BACKGROUND OF THE INVENTION

The invention relates to a reciprocating piston machine with a wobble plate gear, a first part of the wobble plate being in drive connection by means of swivel joint with the machine shaft and the second part thereof with the pistons and the wobbling movement is transferred by means of a rotary bearing from the first to the second wobble plate part.

Reciprocating piston machines of this type are widely known from the patent literature, cf. e.g. U.S. Pat. No. 5,205,718 or DE-A-42 34 989. As the wobbling movement used for the drive of the pistons has, in addition to a component in the direction of the piston movement, also components directed radially thereto, it has hitherto been considered necessary to transfer the wobbling movement on the circumferential area of the wobble plate to the pistons guided in a cylinder by means of connecting rods mounted on both sides by means of ball ends. The minimum length of the connecting rods jointly determined by the maximum inclined position of the wobble plate and their arrangement between the wobble plate and the pistons has led to a relatively large overall length of the reciprocating piston machine. The size of the reciprocating piston machine has a particularly disadvantageous effect, if it is to be located in the engine compartment in the form of a compressor of a vehicle air conditioning system. The problem of the invention is to find a reciprocating piston machine of the aforementioned type, which has a small overall size, which can be manufactured with less effort and less expensively and which has limited frictional losses in the drive transfer from the wobble plate to the pistons.

SUMMARY OF THE INVENTION

According to the invention, this problem is solved in that the drive connection between the second part of the wobble plate and the pistons in each case takes place by means of a ball end, which engages in a guide directed transversely to the piston axis. Thus, unlike in the prior art, connecting rods and in each case two ball and socket bearings on each connecting rod are avoided. Through the combination of the ball end and the transverse guide, compared with the hitherto used ball joints, there is a much smaller contact surface of the drive transfer, so that there are much lower frictional resistances. As a result of the invention the juxtaposed pistons in the circumferential direction of the machine surround the wobble plate and the axial overall length of the machine is correspondingly reduced.

BRIEF DESCRIPTION OF THE DRAWINGS

The invention is described in greater detail hereinafter relative to non-limitative embodiments and the attached drawings, wherein show.

DETAILED DESCRIPTION OF PREFERRED EMBODIMENTS

Figure 1:
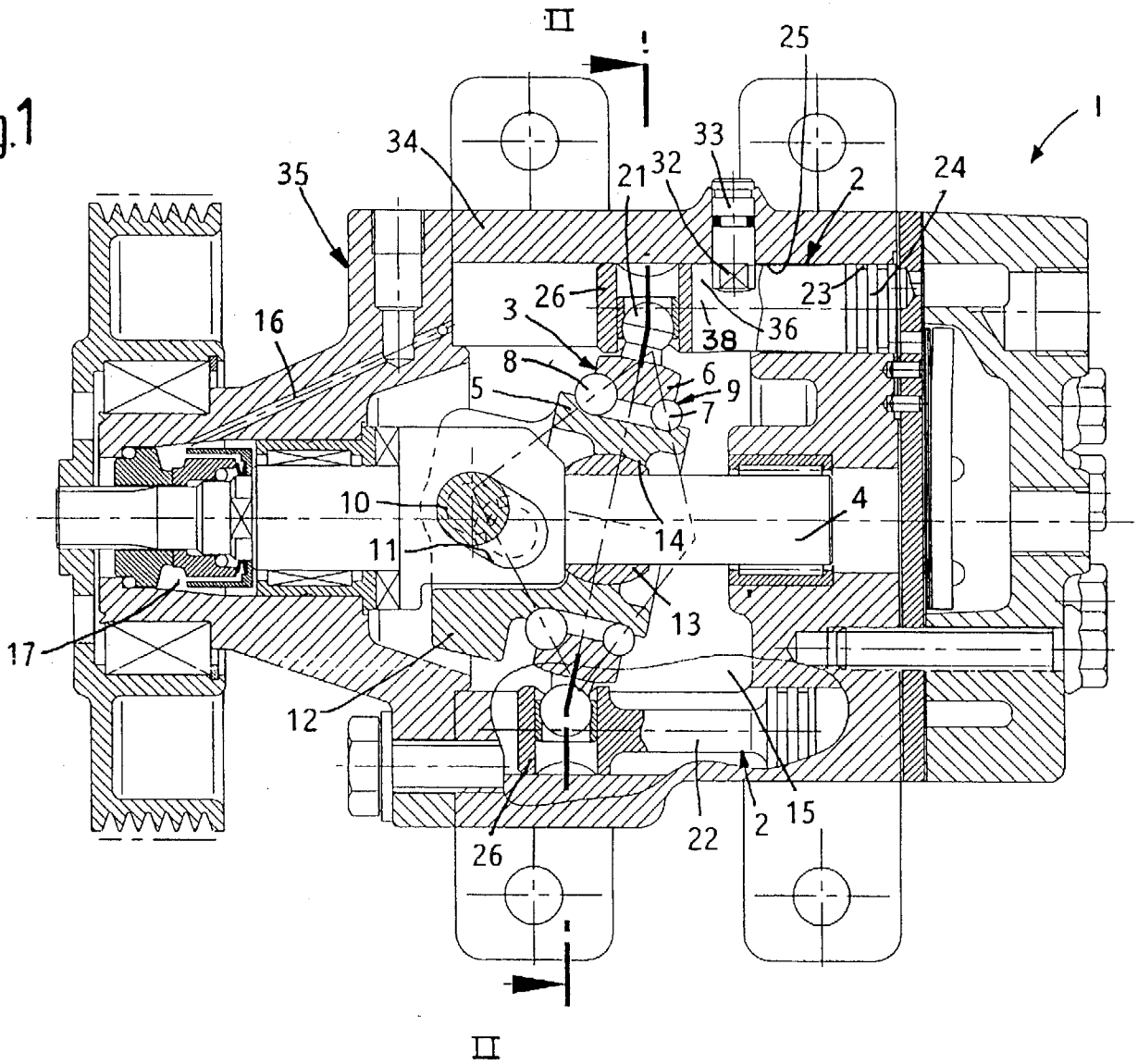
FIG. 1 An axial section through a first embodiment of the reciprocating piston machine.
Figure 3:
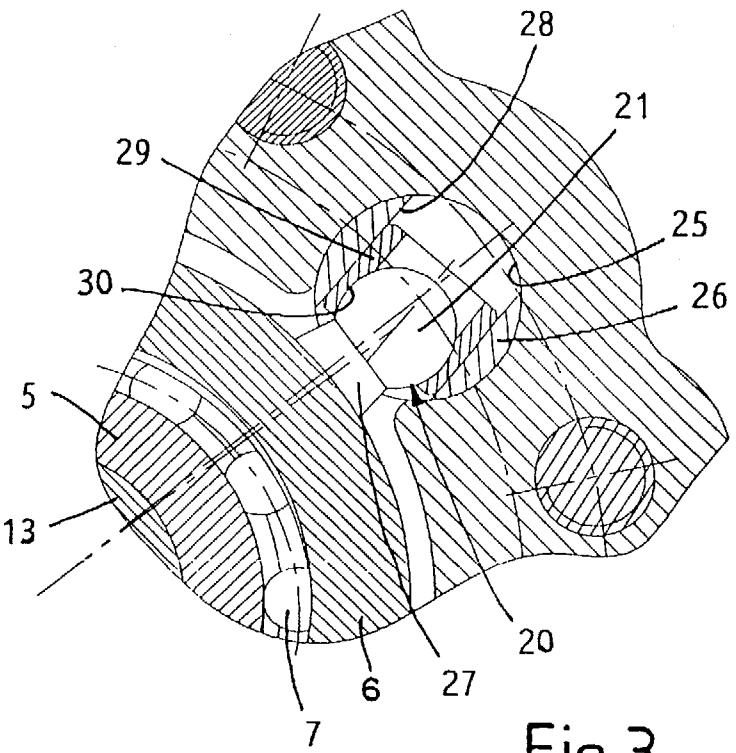
FIG. 3 A larger scale view of an area of FIG. 2.
Figure 2:
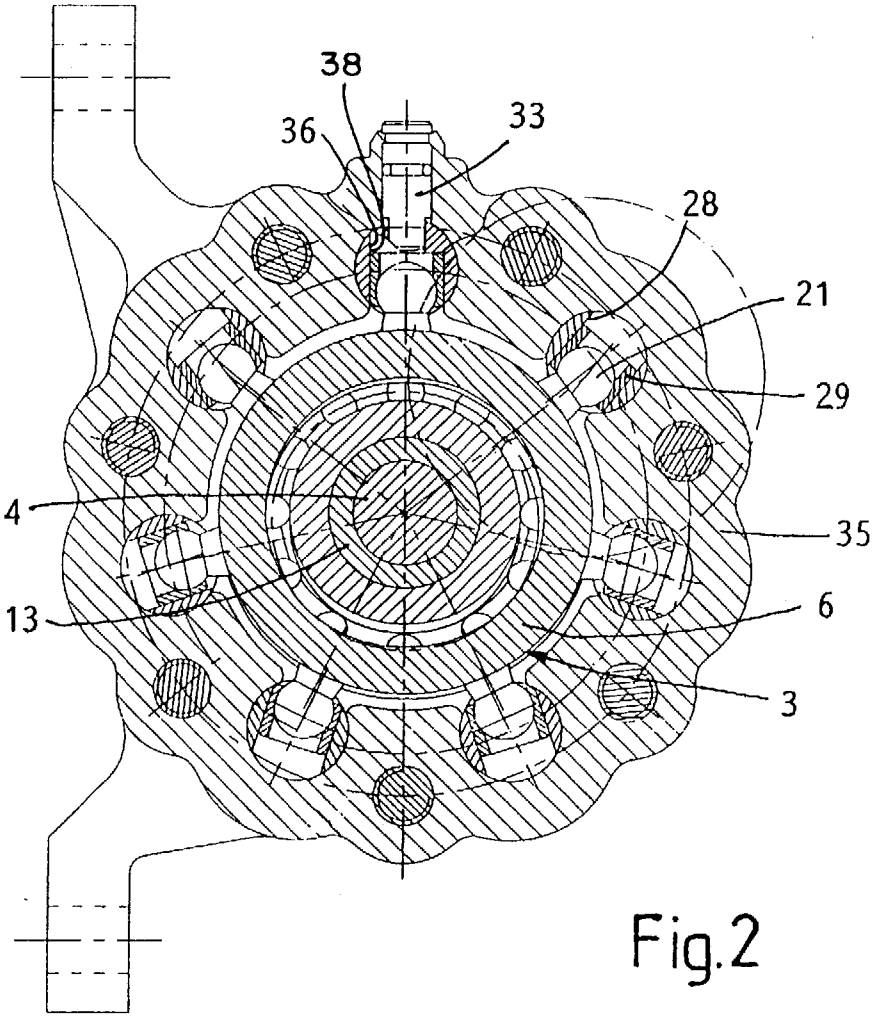
FIG. 2 A section along line II—II of FIG. 1.

The fundamental construction and operation of a reciprocating piston machine with wobble plate gear is known from the literature, such as e.g. U.S. Pat. No. 5,205,718 and DE-A-4139186.

The reciprocating piston machine 1 e.g. has seven pistons 2, which are juxtaposed in the circumferential direction of the machine. The wobble plate 3 has a plate part 5 rotating with machine shaft 4 and a plate part 6 in drive connection with the pistons 2 and consequently not jointly rotating. For this purpose a rotary bearing 9 equipped with bearing balls 7, 8 is located between the two plate parts 5, 6 so as to absorb axial and radial forces, so as to transfer them to the wobbling movement serving for the piston drive.

The connection between the machine shaft 4 and the jointly rotating plate part 12 takes place by means of a driving pin 10, which engages in a recess 11, permitting an angular adjustment of the wobble plate 3, of a driving body 5 shaped laterally onto the jointly rotating plate part 5. For the mounting of the wobble plate 3 on the machine shaft 4 so as to allow a pivoting movement, said shaft carries a spherical body 13, which is surrounded by a correspondingly shaped spherical surface 14 of the jointly rotating plate part 5.

The force for the angular adjustment of the wobble plate 3 is obtained from the sum of the oppositely acting pressures on either side of the pistons 2, so that said force is dependent on the pressure in the drive compartment 15. For regulating this pressure it is possible to provide a flow connection with an external compressed gas flow, which is present when the machine is used as a compressor. This connection can have channels 16, which lead to the sealing and bearing space 17 for the machine shaft 4 and then into the drive compartment 15, so that a cooling is also obtained. In accordance with the inclination of the wobble plate 3 there is a change to the bottom dead centre of the piston movement, whereas the upper dead centre remains unchanged or substantially unchanged. The higher the pressure on the underside of the pistons 2 or in the drive compartment 15 relative to the pressure on the top of the pistons 2 or on the suction side of the compressor, the smaller the stroke of the pistons 2 and therefore the compressor delivery rate.

For the performance of their stroke movement the seven pistons 2 are connected to the circumference of the wobble plate 3. Unlike in the known constructions, each connection between a point on the wobble plate 3 and a piston 2 only has one ball joint 20, in that the nature of the bearing of the ball end 21 allows its movement transversely to the axis of the piston 2 or radially to the wobble plate 3. For this purpose the piston 2 has a shaft or body 22, which rigidly connects the piston top 24 carrying the piston rings 23 to a guide head 26 sliding in the cylinder bore 25.

In the embodiments according to FIGS. 1 to 4, the wobble plate 3 has for each piston 2 a short ball journal 27 extending radially away from it and which engages with the ball end 21 in a cross hole 28 of the guide head 26.

To avoid a linear contact between the ball end 21 and a cylindrical cross hole 28 leading to high pressure loads, preferably the ball end 21, in the manner of the outer races of radial joint bearings, is surrounded by a slip ring 29 with a spherical inner surface 30. As a result of the engagement of the ball end 21 in the slip ring 29, the latter slides during the radial movement of the ball end 21 in the cross hole 28 of the guide head 26.

Figure 5:
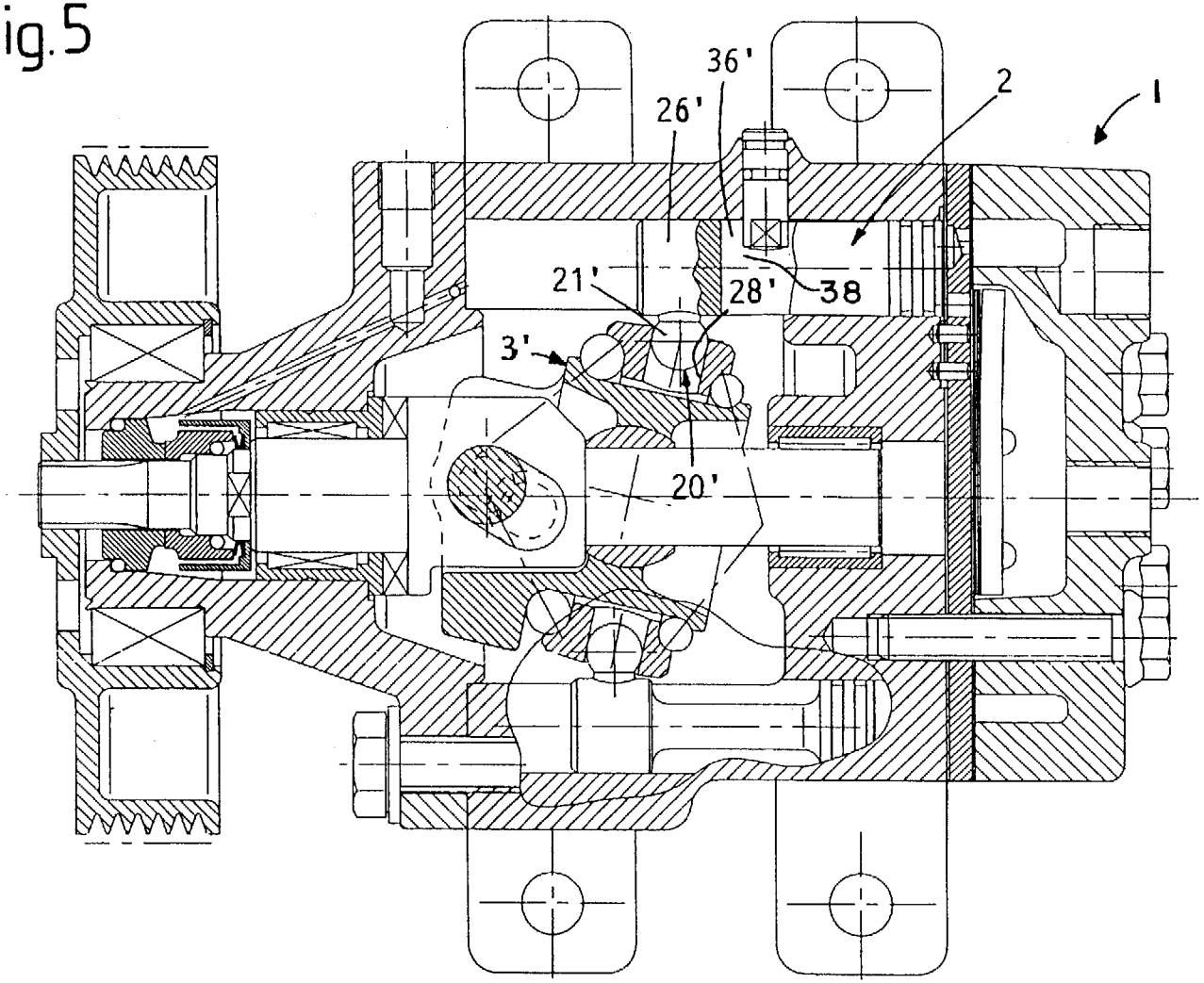
FIG. 5 An axial section through a second embodiment of the reciprocating piston machine.

The embodiment of FIG. 5 illustrates the fact that the ball joint 20' between a piston 2 and a wobble plate 3' can also be implemented with the arrangement reverse to that described hereinbefore, in that a ball end 21' is rigidly fixed to the guide head 26' of the piston 2 and the cross hole 28' receiving it extends radially into the wobble plate 3'. Once again in this embodiment the ball end 21' can be embraced by a not shown sliding sleeve.

In order to ensure that the plate part 6 of the wobble plate 3 does not jointly rotate as a result of the frictional forces of the bearing 9, on at least one piston 2 is provided a rotation preventer, so that the joint rotation is prevented by the hinge or joint connection between the wobble plate 3 and the piston 2. For this purpose a guide pin 33 provided with two flattened portions 32 extends through the wall 34 of the machine housing 35 and engages in an axially parallel guide groove 36 of the piston, so that there is a sliding contact between the flattened portions 32 and the side walls 38 of the guide groove 36.

For the reception of the guide groove 36, the shaft 22 of the piston 2 is provided with a suitable cross-section, which diverges from the slender cross-section shown in the lower part of FIG. 1.

Figure 4:
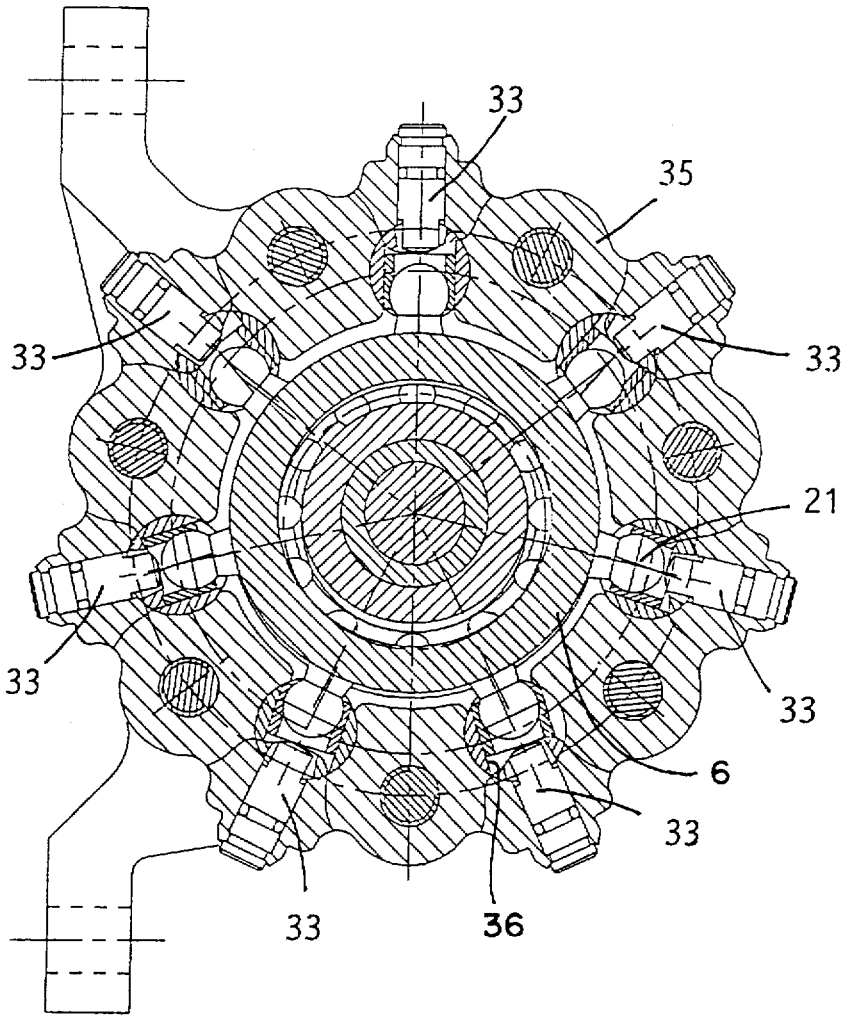
FIG. 4 A sectional representation corresponding to FIG. 2 of an embodiment in which each piston has a rotation preventer.

FIG. 4 shows an embodiment in which each piston 2 is guided by a guide pin engaging in a guide groove 36 against rotation about its axis. The guide pin 33 is enclosed with a certain clearance between the side walls 38 of the guide groove 36. As the seven pistons 2 perform a mutually phase-displaced, oscillating, limited rotary movement, in each wobbling position of the wobble plate 3, rotation prevention with respect to part 6 of the wobble plate 3 is provided by the particular piston with the closest contact between the guide pin 33 and a side wall of the associated guide groove 36. Therefore the guidance contact in the circumferential direction of the machine changes from one piston 2 to the other, so that the stressing or loading by the guidance is correspondingly distributed.

We claim:

1. A reciprocating piston machine comprising: a machine shaft, pistons, a wobble plate, the wobble plate having a first part in drive connection via a swivel joint with the machine shaft and a second part with the pistons wherein wobbling movement is transferred by means of a rotary bearing from the first part of the wobble plate to the second part of the wobble plate and wherein the drive connection between the second part of the wobble plate and each of the pistons is a ball end, the ball end engaging in a guide running transversely to an axis of the piston.

2. A reciprocating piston machine according to claim 1, wherein the second part of the wobble plate has a circumference and each of the pistons has a drive-side end, the ball ends being rigidly fixed to the circumference of the second part of the wobble plate, and the guide extending transversely through the drive-side end of the piston.

3. A reciprocating piston machine according to claim 1, wherein at least one of the pistons has a longitudinal axis and engages a guide element, so that rotation of the piston about the longitudinal axis of the piston is at least closely limited.

4. A reciprocating piston machine according to claim 1, wherein each of the pistons has a rotation preventer.

5. A reciprocating piston machine according to claim 1, wherein the ball end is surrounded by a slip ring having a spherical inner face, the slip ring being displaceably held in the guide.

6. A reciprocating piston machine according to claim 1, wherein the piston has a guide head and a piston top carrying packing rings, the guide head and piston top being interconnected by a piston shaft.

7. A reciprocating piston machine comprising:

a machine shaft;

pistons;

a wobble plate, the wobble plate having a first part in drive connection via a swivel joint with the machine shaft and a second part in drive connection with the pistons;

wherein wobbling movement is transferred by means of a rotary bearing from the first part of the wobble plate to the second part of the wobble plate, and wherein the drive connection between the second part of the wobble plate and at least one of the pistons is a ball joint, the ball joint engaging in a guide within the piston.

8. A machine as claimed in claim 7, wherein the ball joint is attached to the second part.

9. A machine as claimed in claim 8, wherein the piston has a guide head with a cross hole formed therein, the cross hole receiving the ball joint.

10. A machine as claimed in claim 9, wherein a wall defines the cross hole, the machine further comprising a slip ring disposed between the ball joint and the wall for slidable movement of the ball joint within the cross hole.

11. A machine as claimed in claim 7, wherein at least one of the pistons has a rotation preventer.

12. A machine as claimed in claim 11, wherein the piston has a guide groove formed therein and wherein the rotation preventer comprises a guide pin secured in a wall of the machine, the guide pin extending into the guide groove of the piston.

13. A machine as claimed in claim 7, wherein the second part has an outer circumference, the ball joint being attached to the outer circumference of the second part.

14. A reciprocating piston machine comprising:

a machine shaft;

pistons;

a wobble plate, the wobble plate having a first part in drive connection via a swivel joint with the machine shaft and a second part in drive connection with the pistons;

wherein wobbling movement is transferred by means of a rotary bearing from the first part of the wobble plate to the second part of the wobble plate, and wherein the drive connection between the second part of the wobble plate and at least one of the pistons is a ball joint, the ball joint engaging in a guide within the second part of the wobble plate.

15. A machine as claimed in claim 14, wherein the ball joint is attached to the piston.

16. A machine as claimed in claim 15, wherein the second part of the wobble plate has hole formed therein, the hole receiving the ball joint.

17. A machine as claimed in claim 16, wherein a wall defines the hole, the machine further comprising a slip ring disposed between the ball joint and the wall for slidable movement of the ball joint within the hole.

18. A machine as claimed in claim 15, wherein at least one of the pistons has a rotation preventer.

19. A machine as claimed in claim 18, wherein the piston has a guide groove formed therein, and wherein the rotation preventer comprises a guide pin secured in a wall of the machine, the guide pin extending into the guide groove of the piston.

20. A machine as claimed in claim 14, wherein the piston has a guide head, the ball joint being attached to the guide head.

* * * * *